United States Patent [19]

Ahlström

[11] Patent Number: 4,457,475

[45] Date of Patent: Jul. 3, 1984

[54] METHOD FOR DESTROYING TARGETS AND A PROJECTILE FOR CARRYING OUT THE METHOD

[75] Inventor: Lars G. W. Ahlström, Stockholm, Sweden

[73] Assignee: U.S. Philips Corporation, New York, N.Y.

[21] Appl. No.: 298,130

[22] Filed: Aug. 31, 1981

[30] Foreign Application Priority Data

Sep. 15, 1980 [SE] Sweden ..... 8006458

[51] Int. Cl.[3] ..... F41G 7/22

[52] U.S. Cl. ..... 244/3.15; 89/1 A

[58] Field of Search ..... 244/3.1, 3.15, 3.16, 244/3.19; 89/1 A; 102/374, 384

[56] References Cited

U.S. PATENT DOCUMENTS

| | | | |
|---|---|---|---|
| 2,950,477 | 8/1960 | Alpers | 244/3.14 |
| 3,074,062 | 1/1963 | Alpers | 343/13 |
| 3,124,072 | 3/1964 | Herrmann | 102/374 |
| 3,137,850 | 6/1964 | Alpers | 343/13 |
| 3,835,749 | 9/1974 | Joneaux | 244/3.16 |
| 4,004,487 | 1/1977 | Eichweber | 244/3.15 |

FOREIGN PATENT DOCUMENTS 1419471 12/1975 United Kingdom .

*Primary Examiner*—Charles T. Jordan

*Attorney, Agent, or Firm*—Robert J. Kraus

[57] ABSTRACT

The invention relates to destruction of hostile targets (M) by firing controllable explosive projectiles (P, PO) towards the target. The projectiles are provided with target tracking devices for automatic guidance in response to detection of electromagnetic radiation from the target. At least one projectile fired in a burst is provided with transmitter means (T, A1) which is activated after detection of a target (M) for transmission of a signal indicating the position of the target relative to the transmitting projectile to following projectiles in the burst. In these following projectiles a trajectory correction to a trajectory passing through the target is effected by means of the position indicating signal from the preceeding projectile.

6 Claims, 3 Drawing Figures

METHOD FOR DESTROYING TARGETS AND A PROJECTILE FOR CARRYING OUT THE METHOD

BACKGROUND OF THE INVENTION

The invention relates to a method for guiding explosive projectiles provided with target tracking devices toward a target. Each target tracking device receives and detects electromagnetic radiation and produces an error signal indicating a deviation between the respective projectiles trajectory and a trajectory passing through the target. The error signal controls guiding means on the projectile to reduce the deviation to zero.

In order to improve the accuracy of projectiles provided with such tracking devices, it has previously been proposed to illuminate the target area with electromagnetic radiation, to which the tracking device is sensitive. It is difficult, however, to sufficiently illuminate the target at a reasonable cost and reliability. If the illuminator is placed at a large distance from the target, in order to be protected, a very high power illumination source is needed. If the illuminator is placed in a unit situated closer to the target, for example in an airplane which flies across the target, it will be exposed to the risk of hostile fire.

In order to solve these problems it has previously been proposed to fire a burst of projectiles including a special projectile having an illumination source for illuminating the target area. The only purpose of this projectile is to illuminate an area where a target may be present, as an aid for other projectiles so that the tracking devices in these projectiles can more easily discover the target. Such an illumination projectile does not deliver any information about the target, because it illuminates a given area independently of whether or not there is a target within the illuminated area. Thus, the illumination is not directly selective or target indicative.

SUMMARY OF THE INVENTION

An object of the invention is to provide a simple, inexpensive and effective solution of the above problems. In accordance with the invention, a plurality of projectiles fired at a target includes at least one projectile having transmitter means which is activated in response to detection of the target. The transmitter means is adapted to transmit to at least one other projectile a signal indicating the position of the target relative to the transmitting projectile trajectory, to effect a trajectory correction in the other projectile.

The transmitter means is preferably activated at the end of the trajectory of the projectile.

In a method according to the invention a projectile, which approaches a target and has detected this target, transmits information about the position of the target relative to the projectile to another projectile, such as the closest following projectile. In this following projectile a trajectory correction is effected by using the received position information in combination with information about the position of the transmitting projectile, which is available in the following projectile's own target tracking device. Thus the following projectile is guided to follow a more correct trajectory towards the target. The target tracking device in the following projectile thus does not need to discover the target itself during this correction phase, but utilizes the detector in the foregoing projectile for its correction. When the transmitting projectile hits the ground or the target, the following projectile continues in its corrected trajectory and tries in this phase to detect the target on its own. When the target's own radiation is detected, it is used for final guidance.

In one embodiment all projectiles are provided with transmitter means which are each activated at the end of the respective projectile's trajectory, for transmitting target information to the following projectile. In a burst of such projectiles, each projectile will have a more accurate trajectory towards the target than the closest foregoing projectile, and a reliable hit will be obtained after a relatively small number of projectiles complete their trajectories. It is also an advantage to have to manufacture and use only one type of projectile.

One form of a projectile for carrying out the method according to the invention comprises transmitter means with modulator or coding means which are controlled by a detector adapted to detect a target and to determine the position of the target relative to the projectile. The transmitter means transmits a modulated signal after detection of a target, which signal indicates the position of the target. The target tracking device in the cooperating receiving projectile includes means for demodulating or decoding the position indicating signal and means for combining the position information thus obtained with the receiving projectile's own position signal in the tracking device. The combined information is used to produce a resulting control signal which is used to correct the projectile trajectory to a trajectory passing through the target.

Suitably the projectile has both a target tracking device and transmitter means for position indicative transmission. The detector device for activating the transmitter means can be the same detector as that included in the tracking device.

Because the guiding of a projectile according to the invention is effected in two phases, namely the correction phase and the independent target tracking phase, the target tracking device preferably has two reception channels. One channel is provided for reception of the coded position indicating signal and one is provided for reception of the target's own radiation or radiation reflected from the target. Switching means is provided for automatic switching between the first reception channel, when a signal is received from another projectile, and the second reception channel, when the signal has disappeared.

BRIEF DESCRIPTION OF THE DRAWING

The invention is described with reference to the accompanying drawing illustrating a simplified block diagram of a projectile provided with a target tracking device combined with means for transmission of a position indicating signal to a following projectile. The different figures show the projectile in different stages of a trajectory towards a target. More particularly.

DESCRIPTION OF THE PREFERRED EMBODIMENT

Figure 1A:
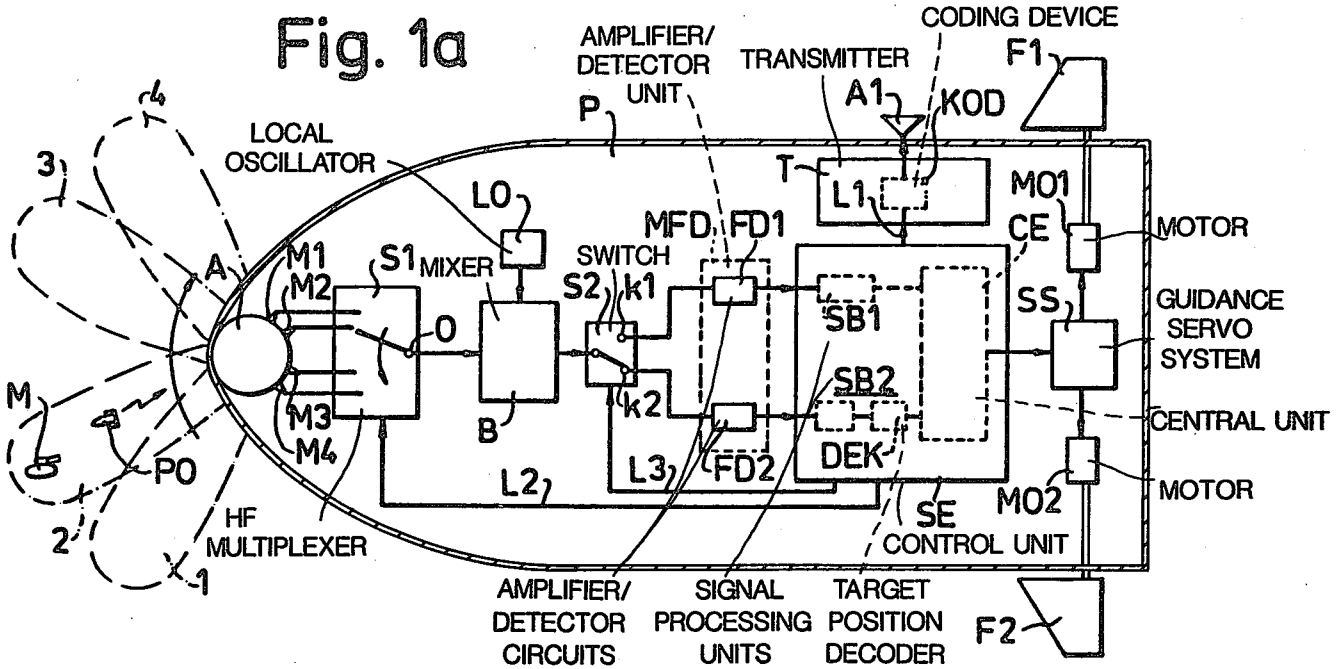
FIG. 1*a* shows the condition in the projectile when it is situated at a large distance from a target, for example 2–3 km, when a foregoing projectile has detected the target and transmits a target position indicating signal.

All projectiles in a burst of projectiles are in the given example assumed to be identical and provided with both a tracking device and a transmitter means for transmission of a position indicating signal at the end of the projectile trajectory. The projectiles are fired at such short intervals that, when a projectile is under flight towards the target and transmits a position indicating signal, the closest following projectile is situated at a suitable distance for receiving the transmitted position indicating signal, for example 2–3 km from the target.

The illustrated projectile P has in its nose an antenna A in the shape of a so called Luneberg lens, which in the given example has four feeders M1, M2, M3 and M4 corresponding to four sensitivity lobes designated 1, 2, 3 and 4, respectively. The feeders are each connected to an input of a HF multiplexer, for example a so called PIN-switch S1, the common output O of which leads to an input of a mixer B. In the mixer the energy from the antenna A is combined with the energy from a local oscillator LO and the mixing product passes at intermediate frequency via a switch S2 and an amplifier and detector unit MFD to a control unit SE, which preferably comprises a micro processor. The control unit delivers, via a guidance servo system SS, control signals to two motors MO1 and MO2 each driving its guiding fin F1, F2.

The amplifier and detector unit MFD contains filtering, amplifying and detector means in order to separate the target position signals from the received radiation. The target tracking device can according to the invention operate in two operation modes, in which there are different requirements laid upon the amplifier and detector unit. The unit MFD is divided into two circuits FD1 and FD2 which can be made active alternatively by means of switch S2. The signal processing in SE is also different in the two different operation modes and is divided into two units SB1 and SB2, one for the signal from FD1 and the other for the signal from FD2. The signals obtained by the signal processing in SB1 and SB2, respectively, are coupled to a central unit CE included in the control unit SE, which central unit delivers its output signal to the servo system for influencing the guiding fins.

According to the invention each projectile is further provided with a transmitter T which in the given example has its output connected to a separate antenna A1, suitably directed for transmission to the receiving projectile. The transmitter T comprises a coding device KOD and is controlled via a control line L1 from the control unit SE. The control unit SE also controls via control lines L2, L3 the setting of the HF-multiplexer S1 and the switch S2, i.e. which one of the antenna lobes and which one of the amplifier, detector and signal processing units is active.

The transmitter T transmits radiation for which the circuit FD2 in the amplifier and detector unit MFD is adapted. The transmitter T is only started under the condition that a target has been detected by the projectile's own tracking device and the signal, which is transmitted by T after initiation, is coded in such a manner by means of the coding device KOD that it gives information about the position of the detected target relative to the projectile's trajectory. In a simple embodiment a digital code is used which gives information about which one of the lobes the detected target is situated in. For example, the code would require transmission of one pulse if the target is situated in lobe 1, two pulses if the target is situated in the lobe 2, three pulses if the target is situated in lobe 3 and four pulses if the target is situated in lobe 4. In principle any code can be used for indicating the position of the target.

The projectile functions as follows, reference first being made to FIG. 1*a*.

In FIG. 1*a* the projectile is situated so far from a target that the projectile's own target tracking device in its normal operation mode is not able to detect radiation from the target or radiation transmitted by the projectile and reflected by the target, but it has in FIG. 1*a* been assumed that the closest foregoing projectile in the burst, which is shown at PO in the drawing, has detected a target M and transmits a coded signal indicating the position of the target relative to the projectile PO. The tracking device in projectile P, by command from SE, sets its switch S2 in the position k2, in which the amplifier and detector circuit FD2 and the signal processing unit SB2 are active. This adapts the device for reception of the transmitted radiation from PO. The signal processing in the unit SB2 includes extraction of the target position indicating code transmitted from the transmitter of the foregoing projectile, which function is indicated by the block DEK in the drawing. The code obtained by the decoding in DEK is stored in a memory in the central unit CE. The signal processing in the unit SB2 also determines the position of that point from which the radiation is received, i.e. in the present case the position of foregoing projectile PO relative to the trajectory of projectile P. By means of this position determination an error signal can be generated, which indicates the deviation between the two projectile trajectories. If this error signal is fed to the servo system for influencing the guiding fins, projectile P will be guided to follow the same trajectory as the foregoing projectile PO. However, in the present case the error signal is combined with stored information about the position of the target relative to the trajectory of the foregoing projectile for obtaining a resulting error signal, which indicates the deviation between the trajectory of the projectile P and a trajectory passing through the target. This resulting error signal is fed to the servo system SS and influences the guiding fins F1, F2 via the motors MO1, MO2 to reduce the error signal to zero by correcting the projectile trajectory in a direction towards the target.

When the foregoing projectile which has transmitted the target position indicating signal hits the ground the signal will disappear, causing the control unit SE to reset the switch S2 to the position K1 which is the normal passive listening position. Memory means, either in the central unit CE or in the servo system SS, ensure that the correction carried out in the foregoing operation mode by adjusting the fins F1, F2 will remain and the projectile will continue in its corrected trajectory towards the target.

The tracking device now is in its listening mode in which the antenna is scanning, the transmitter T inactivated, while the switch S2 is set in the passive tracking or listening position k1. In the example given, passive operating in the millimeter range generally requires broad band reception because the frequency of radiation from the target is not known and it is important to receive as much energy as possible from the target.

Figure 1B:
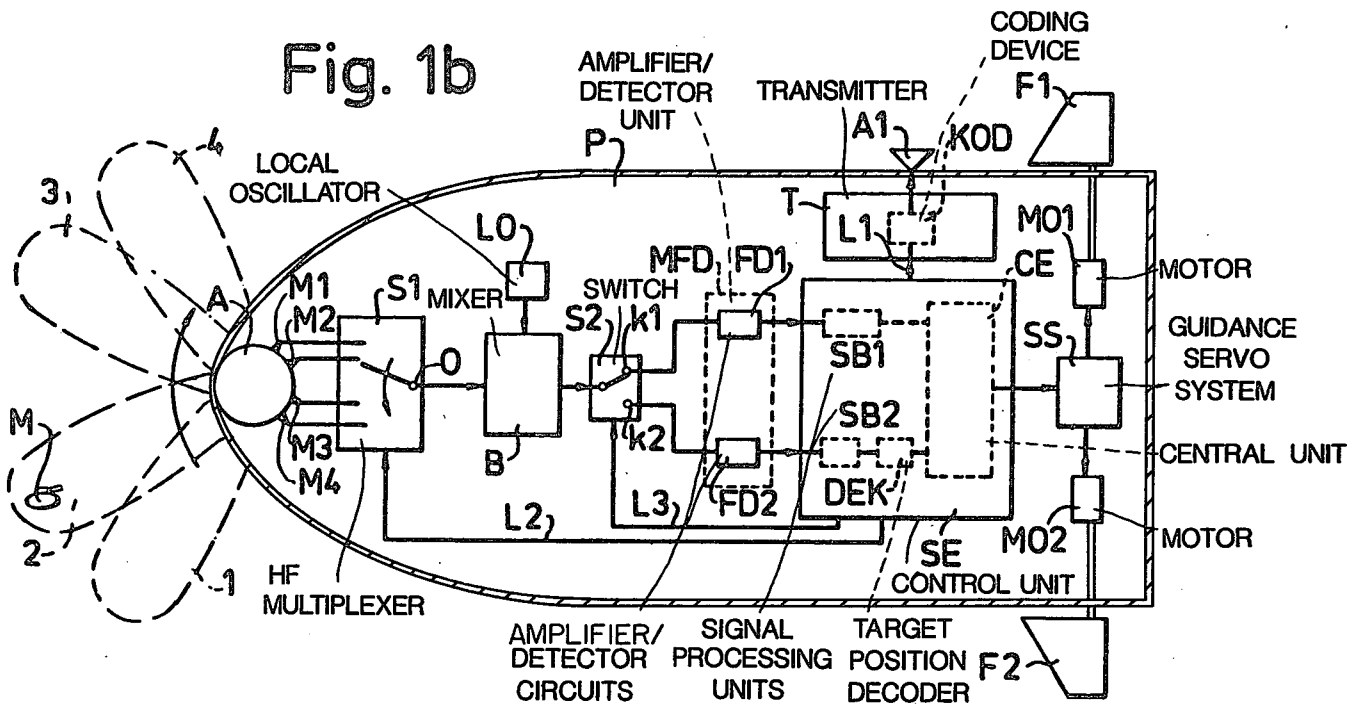
FIG. 1*b* shows the condition in the projectile when the position indicating signal has disappeared and the tracking device has to operate on its own without help from the foregoing projectile.

In the situation shown in FIG. 1*b* it has been assumed that the tracking device has discovered the target M by its own radiation in lobe 2. The switch S2 remains in the position k1 and the received signal passes via FD1 to SB1 for signal processing. This signal processing attempts to determine the position of the target relative to the projectile trajectory and to derive therefrom an error signal representing the deviation between the projectile trajectory and a trajectory passing through the target. This error signal is coupled to the control servo system and the driving motors for adjusting the guiding fins in such manner that the error signal is reduced to zero. If the tracking device is able to reduce the error signal to exactly zero, the projectile will hit the target.

Figure 1C:
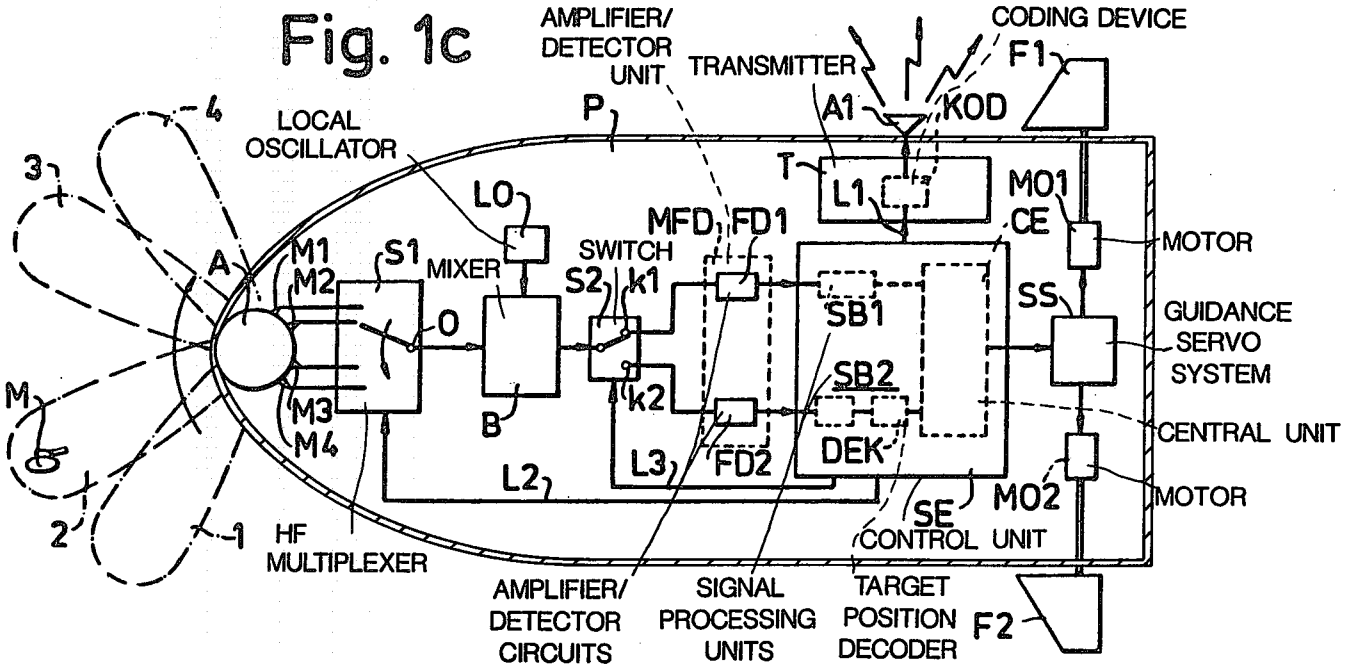
FIG. 1*c* shows the condition in the projectile when it is situated close to the target and transmits a position indicating signal to the following projectile or projectiles. The target tracking device is of conventional construction and is only shown schematically.

During the last part of the trajectory of the projectile towards the target the transmitter T is activated via the control line L1, which is illustrated in FIG. 1*c*. The transmitter T repeatedly transmits a code which indicates the position of the target relative to the projectile, suitably a digital code indicating that antenna lobe, in which the target is present. Because the transmitter T has its own antenna A1, the transmission of the position indicating code can occur while the tracking device operates in its normal passive control mode, in which the antenna is scanning and the switch S2 is in position k1, as shown in FIG. 1*c*. The transmitter T may for example be initiated as soon as a target has been detected and its position has been determined and can continue until the projectile hits the ground. If desired, the initiation of the transmitter T can be effected after a certain delay, so that the position indicating code is only transmitted during the last part of the trajectory of the projectile. In an alternative embodiment, in which the transmitter T utilizes the same antenna means as that included in the tracking device, the coded transmission can be effected intermittently and alternatingly with the passive control mode during the last part of the trajectory of the projectile towards the target.

The invention is not limited to any special type of target tracking device but can be used with all known target tracking devices, for example such devices operating according to the radar principle or with visible light, laser light, IR radiation etc. The invention can also be used both in projectiles without self propulsion means and in projectile's with self propulsion means such as missiles.

I claim:

1. A method for guiding explosive projectiles fired towards a target, each projectile including a target tracking device which operates by receiving and detecting electromagnetic radiation and generating an error signal indicating a deviation between the respective projectile's trajectory and a trajectory passing through the target, said error signal controlling guiding means on the projectile to reduce the deviation, characterized in that a burst of projectiles is fired, including at least one projectile which is provided with transmitting means controlled by means for detecting a target, said transmitting means responding to detection of a target by transmitting a signal indicating the position of the target relative to the respective projectile, to another projectile in the burst, for effecting trajectory correction in said other projectile.

2. A method as in claim 1, characterized in that the transmitting means is activated at the end of the trajectory of the respective projectile.

3. A method as in claim 2, characterized in that all projectiles fired in a burst are identical and are provided with said transmitting means.

4. A projectile including a target tracking device for interacting with other projectiles to affect guidance of the projectile to a target at which they are fired, said device including:

(a) receiving and detecting means adapted for receiving and detecting electromagnetic radiation from the target and a target position indicating signal from another projectile, representing the position of the target relative to the other projectile;

(b) signal processing means coupled to the receiving and detecting means for producing a target position indicating signal representing the position of the target relative to the respective projectile, and for deriving from this signal an error signal representing deviation of the projectile trajectory from a trajectory passing through the target; and (c) guiding means responsive to the error signal for correcting the projectile trajectory to reduce said deviation.

5. A projectile as in claim 4, where said target tracking device includes transmitting means for transmitting the target position indicating signal produced by the signal processing means to another projectile.

6. A projectile as in claim 4 or 5, characterized in that the receiving and detecting means comprises:

(a) a first channel for receiving the target position indicating signal from another projectile;

(b) a second channel for receiving the radiation from the target; and (c) switching means for affecting operation of the first channel when a target position indicating signal is being received from another projectile and for affecting operation of the second channel when said signal is not being received.

* * * * *